US007380597B2

(12) United States Patent
Edwards et al.

(10) Patent No.: US 7,380,597 B2
(45) Date of Patent: Jun. 3, 2008

(54) DEPLOYMENT OF UNDERGROUND SENSORS

(75) Inventors: John Edwards, Medinat Al Alam (OM); Philippe Gambier, Rosharon, TX (US); Vincent Tourillon, Edmonton (CA); Christian Chouzenoux, St. Cloud (FR); Emmanuel Rioufol, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 200 days.

(21) Appl. No.: 10/511,996

(22) PCT Filed: Apr. 10, 2003

(86) PCT No.: PCT/EP03/50102

§ 371 (c)(1),
(2), (4) Date: May 10, 2005

(87) PCT Pub. No.: WO03/100218

PCT Pub. Date: Dec. 4, 2003

(65) Prior Publication Data

US 2005/0217848 A1 Oct. 6, 2005

(30) Foreign Application Priority Data

Apr. 24, 2002 (GB) ..... 0209350.8

(51) Int. Cl.
*E21B 43/00* (2006.01)

(52) U.S. Cl. ..... 166/250.01; 166/250.07; 166/336; 166/66; 166/311

(58) Field of Classification Search ..... 166/250.07, 166/250.01, 336, 66, 311
See application file for complete search history.

(56) References Cited

U.S. PATENT DOCUMENTS

| | | | | |
|---|---|---|---|---|
| 3,823,773 | A * | 7/1974 | Nutter | 166/336 |
| 5,189,909 | A * | 3/1993 | Oike et al. | 73/152.18 |
| 5,195,588 | A * | 3/1993 | Dave | 166/264 |
| 5,692,565 | A * | 12/1997 | MacDougall et al. | 166/264 |
| 5,765,637 | A * | 6/1998 | Dietle et al. | 166/55 |
| 5,829,520 | A * | 11/1998 | Johnson | 166/250.01 |
| 6,070,662 | A * | 6/2000 | Ciglenec et al. | 166/254.1 |
| 6,994,167 | B2 * | 2/2006 | Ramos et al. | 166/286 |

* cited by examiner

*Primary Examiner*—William P. Neuder
*Assistant Examiner*—Nicole Coy
(74) *Attorney, Agent, or Firm*—James Kurka; Bryan L. White; Darla Fonseca

(57) ABSTRACT

A method of installing a sensor located in a chamber on the out-side of a casing, comprising the steps of positioning the casing in a well, cementing the casing in position, positioning a drilling tool inside the casing level with the chamber, drilling through the casing, chamber and cement into the formation surrounding the well so as to create a fluid communication path, and sealing the hole drilled in the casing.

18 Claims, 3 Drawing Sheets

FIG.1
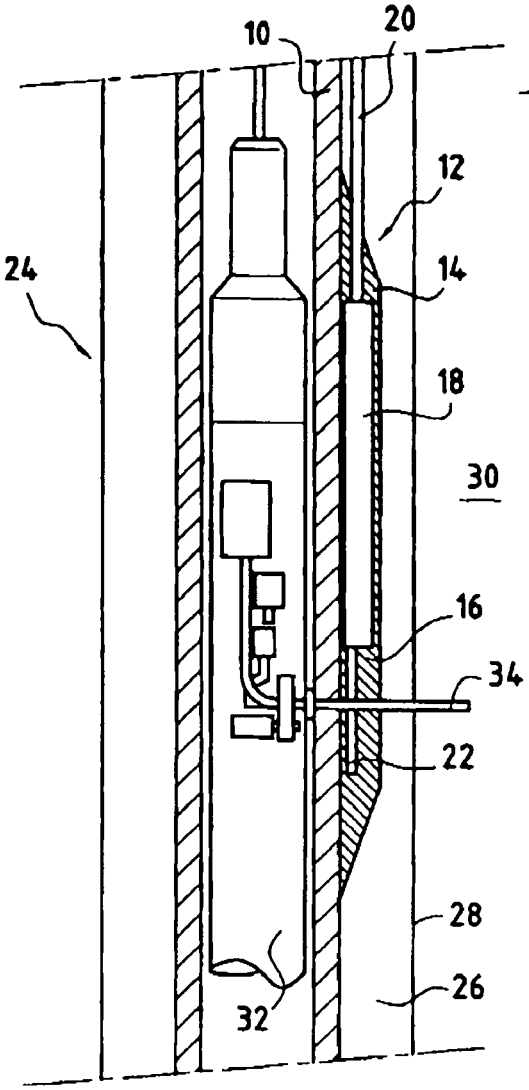
FIG.2
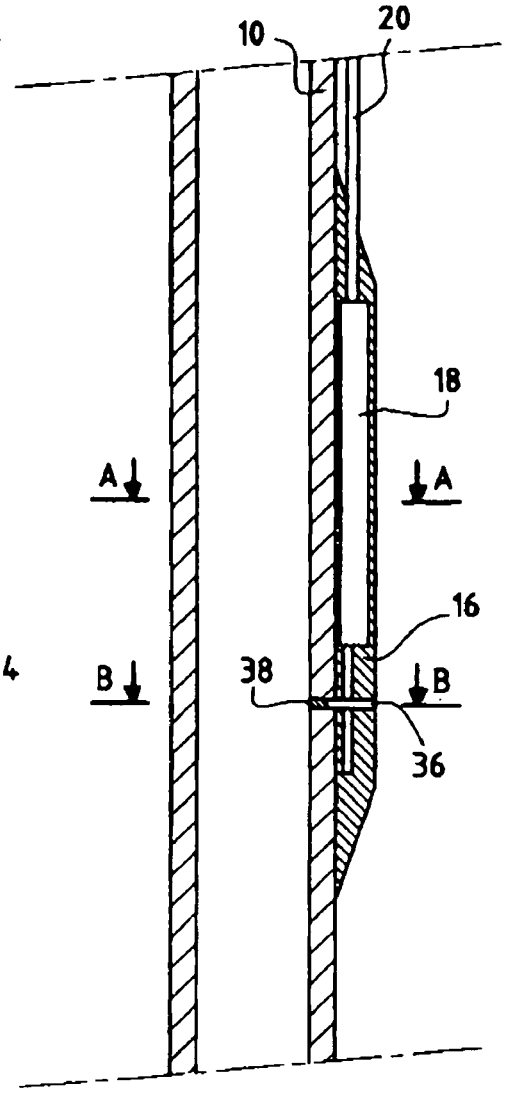
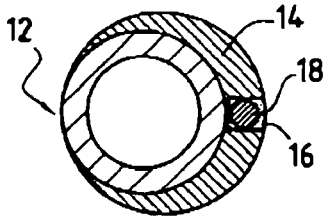
FIG.3
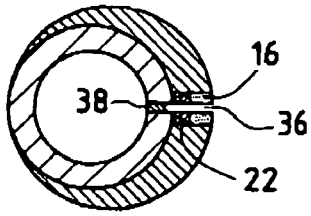
FIG.4

FIG.8
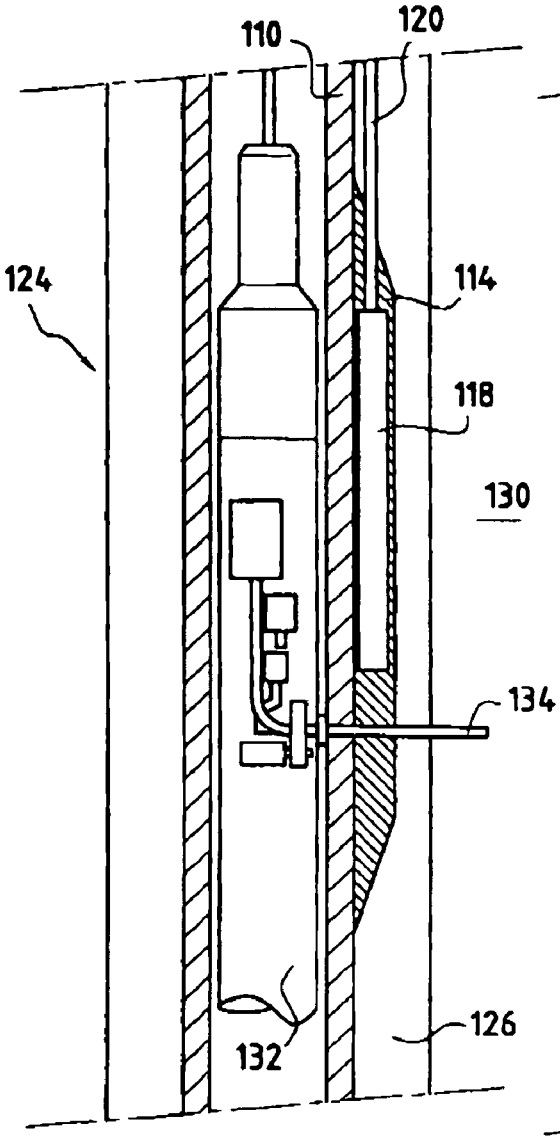
FIG.9
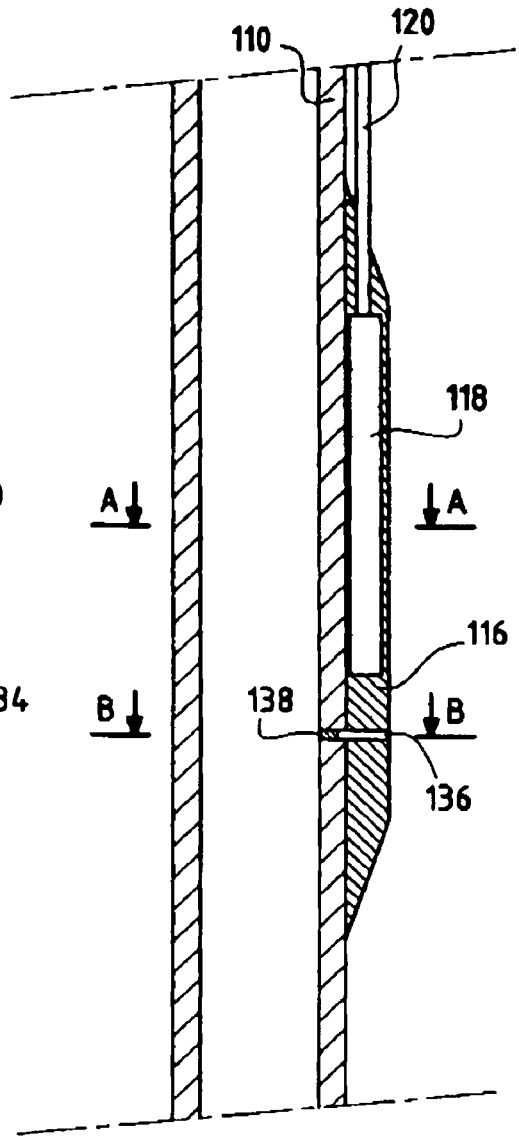
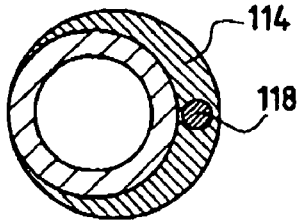
FIG.10
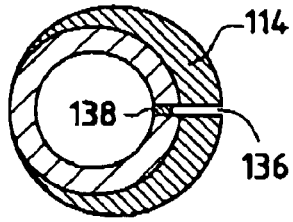
FIG.11

DEPLOYMENT OF UNDERGROUND SENSORS

The present invention relates to methods of deploying underground sensors and to systems and apparatus utilizing underground sensors. In particular, the invention relates to such methods, systems and apparatus for making underground pressure measurements This invention is particularly concerned with the measurement of the pressure of fluids in formations surrounding a borehole such as an oil, water or gas well. formation pressure measurement is one of the basic measurements made on a formation to determine the properties of an underground reservoir, particularly a hydrocarbon reservoir. When a well is first drilled, it is relatively easy to make such a measurement by placing a probe in contact with the borehole wall and using the probe to sense the pressure of fluids in the formation. Such a measurement can be made by the MDT tool of Schlumberger. The MDT tool is lowered into the well in question and a hollow probe extended into contact with the borehole wall. The probe is connected to an accurate pressure gauge which allows the pressure of the fluids in the formation at that location to be determined. Such measurements are made at different locations in the well to provide formation pressure measurements along the sections of interest.

Measurements such as those made by the MDT tool can be characterized as open-hole, wireline measurements. That is, they are made just after the well has been a drilled, and are made by means of a tool that is lowered into the well by means of a wireline cable and logged through the well on this cable and removed from the well when the measurements are completed. Tools such as the MDT tool are relatively large and expensive so cannot be left in the well for any period of time.

Once a well has been drilled, it is typically completed by installing a liner or casing into the well. Normally this casing is made of steel and is fixed into the well by cement that is placed in the annulus between the outer surface of the casing and the borehole wall Completion of the well in this manner serves a number of purposes. The cement and casing provide physical support to the well to prevent it collapsing or becoming eroded by flowing fluids. The cement also provides isolation between the various zones of the formation penetrated by the borehole so as to prevent fluid communication between these zones of the formation which might inhibit production of desired fluids such as oil, and the cement and casing prevent the ingress of undesirable fluids, such as water in an oil well, that can dilute useful production or require the use of expensive and complex surface equipment to separate oil and water. While the benefits of completion in this manner are well known, it does mean that it is not possible to obtain easy access to the formation for making pressure measurements after the completion has been installed.

Various approaches have been proposed to enable measurements to be made on formations after a well has been completed in the manner described above.

In U.S. Pat. No. 6,234,257 and U.S. Pat. No. 6,070,662 a sensor is disposed inside a shell which is forced into the formation. This can be achieved by the use of an explosive charge while the well is being drilled. The sensor can then be interrogated for an extended period after the drilling is finished by means of an antenna which can communicate through an aperture provided in the casing.

SPE 72371 describes a tool (the CHDT tool of Schlumberger) which allows pressure testing of the formation after completion of the well. The tool drills a hole through the casing and cement into the formation and a probe is placed over the hole to sense the formation pressure and take samples of formation fluid if required. Once the measurement is complete, a plug or rivet is placed in the hole in the casing, sealed and pressure tested to confirm the integrity of the casing.

It has been proposed to install permanent sensors on the outside of the casing to allow long term monitoring of formation pressure. However, since cement is usually impermeable, it would be necessary to provide some means of fluid communication between the formation and the sensor in order that pressure can be measured. One proposal has been to mount the sensor in a chamber on the outside of the casing that also carried an explosive charge. After installation and cementing, the charge is fired to provide a communication path into the formation. This approach is not preferred in many cases since it requires the use of explosive charges which brings with it safety considerations and extensive complexity for controlling the firing of the charge. The damage caused by the charge might be sufficient to damage the sensor too. Another potential problem is that since the perforation tunnel is not open to the well, fluid does not flow through the perforation and allow cleaning of residues. Therefore there is now way to ensure that there is good fluid communication between the formation and the sensor. Since the charge is mounted on the outside of the casing, it may be necessary to use a smaller casing size than normal to fit into the borehole. Further details of this approach can be found in U.S. Pat. No. 5,467,823.

Other methods of installing permanent sensors that allows communication with the formation relies on the use of non-cemented casing or liners.

The present invention attempts to provide method and systems for deploying sensors in communication with underground formations.

In accordance with the present invention, there is provided a method of installing a sensor located in a carrier on the outside of a casing, comprising the steps of positioning the casing in a well, cementing the casing in position, positioning a drilling tool inside the casing level with the carrier, drilling through the casing, carrier and cement into the formation surrounding the well so as to create a fluid communication path, and sealing the hole drilled in the casing.

The drilling and sealing operations are preferably performed using a tool such as the CHDT tool of Schlumberger. In order to ensure good fluid communication between the formation and the chamber, the tool can be used to create a drawdown across the drilled hole to produce reservoir fluid through the hole and clean it of debris and skin damage.

The carrier can comprise a permeable support in which the sensor is encapsulated, a hollow chamber in which the sensor is mounted, or combinations of these approaches.

A particularly preferred installation has the sensor mounted at one end of an elongate chamber. The hole is drilled through the chamber at a point remote from the location of the sensor to avoid damaging the sensor. In order to ensure good fluid communication with the sensor, a buffer tube can be installed in the chamber which extends to the sensor. The hole is drilled through the buffer tube as well as the chamber in this case. Alternatively, the chamber can be filled with a permeable material such as a permeable cement or sintered metal to allow fluid communication with the sensor.

Where the sensor is encapsulated in the carrier, the permeable material can comprise permeable cement, sintered metal or other such materials.

Means are preferably provided to allow the drilling and plugging tool to be positioned inside the casing accurately relative to the chamber through which it is to drill. One such approach is the Indexing Casing Coupling system of Schlumberger. In such a system, a specific profile is provided inside the casing to identify a given depth and an orientation profile is provided for a given orientation inside the casing. Corresponding depth and orientation keys are provided on a landing tool which is lowered into the well such that it can be positioned relatively accurately at a given depth and orientation allowing accurate drilling through the casing, chamber, cement and into the formation.

Another approach is to use the drilling tool to make a measurement on the formation surrounding the well, for example a gamma ray measurement, that allows the depth of the tool in the well to be determined relatively accurately from a knowledge of the depth of formation features.

A series of sensors can be installed by providing multiple sensors, each in a chamber on the outside of a respective casing.

Whether one or more sensors is installed, it is preferred to communicate data to the surface by means of a cable running along the outside of the casing in the well. This cable can provide power to the or each sensor.

When installing casing carrying sensors into the well which are to be connected to the surface by means of a cable, the casing can be rotated as it is inserted into the well such that the cable is wound in a spiral manner around the casing.

The cable running along the outside of the casing can be provided with regularly spaced standoffs which allow a space to be maintained between the cable and the outside of the casing. This in turn allows good cement placement around the cable.

The present invention will now be described by way of examples and in reference to the accompanying drawings, in which:

FIG. 1 shows a schematic view of a drilling operation to connect a sensor to the formation;

FIG. 2 shows a view of the casing with the hole plugged after drilling;

FIG. 3 shows a cross-section through the casing on line AA of FIG. 2;

FIG. 4 shows a cross-section through the casing on line BB of FIG. 2;

Figure 6A:
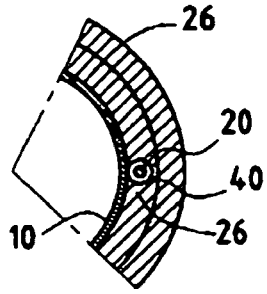
Figure 6A:
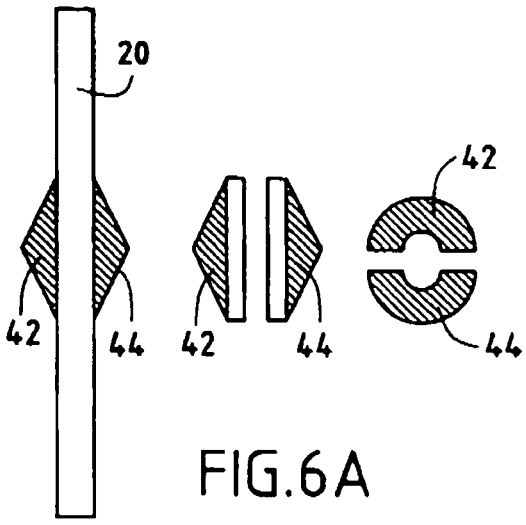
Figure 6B:
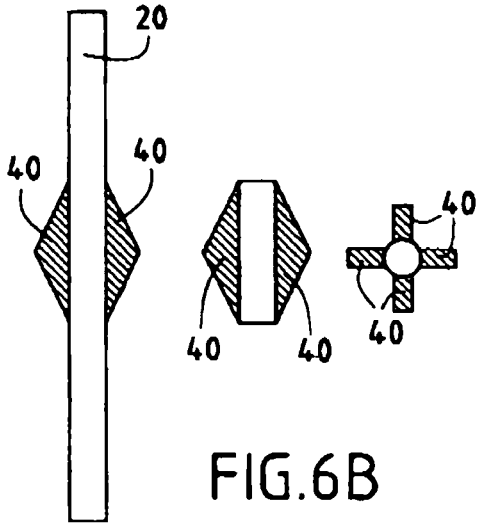
Figure 7:
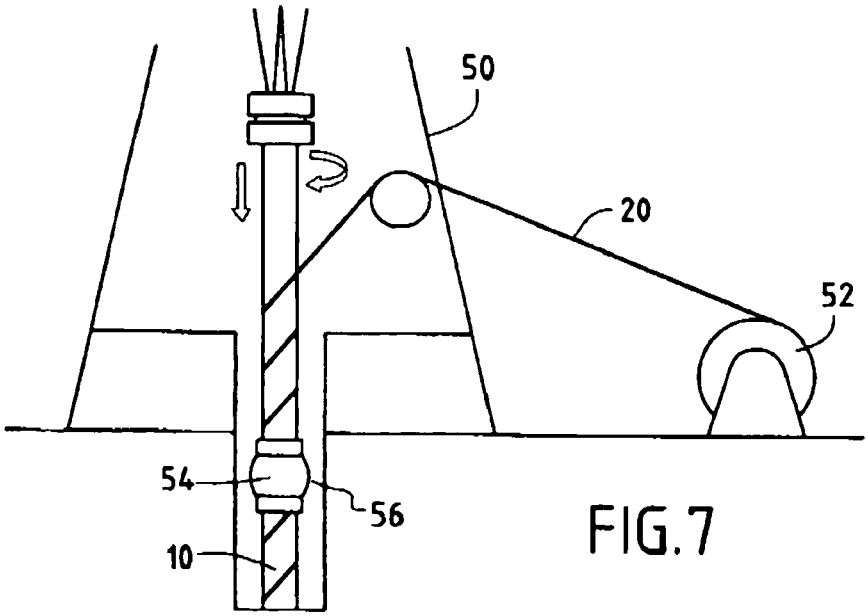

FIGS. 6*a* and 6*b* show details of cable spacers;

FIG. 7 shows a view of the installation of the cable at the surface; and

FIGS. 8-11 show another embodiment of the invention and correspond to FIGS. 1-4.

Referring now to the drawings, FIGS. 1-4 show a casing installed in a well. The casing 10 has an enlarged section 12 forming a carrier 14 in which a chamber 16 is defined. A pressure gauge 18 is located at one end of the chamber 16 and is connected to a data and power cable 20 and to a buffer tube 22 which is filled with a relatively incompressible liquid. The buffer tube 22 is flattened against an outer wall of the casing 10 in a flat bean shape covering an arc of the casing I0. An indexing device (not shown), such as an ICC profile, can be provided in the casing 10 above the carrier 14 and the distance from the indexing device to the buffer tube 22 measured with relative accuracy at the surface, before the casing is installed in the well.

The casing 10 forms part of an extended casing completion (not shown) which is run into the well 24 in the manner described below. Once installed in the well 24, cement 26 is placed in the annulus between the outside of the casing 10 and the borehole wall 28 and allowed to set to provide support for the casing 10 and borehole wall 28 and zonal isolation of the formations penetrated by the well. Thus it will be appreciated that the cement 26 is impermeable and allows no fluid communication between the formation 30 and the surrounding environment.

A drilling tool 32 such as the CHDT, is run into the casing 10 after the cement 26 has set by means of a wireline cable (not shown) and is lowered until an indexing tool (not shown) reaches the indexing device described above. The tool 32 is positioned at a predetermined distance below the indexing tool so that when the indexing tool is positioned in the indexing device, the tool 32 is positioned adjacent the buffer tube 22.

In cases where the tool 32 also includes a gamma ray or other such measurement, it is possible to determine the position of the tool in the well using a knowledge of the depths of the formations surrounding the well as a guide. This can help compensate for any casing depth inaccuracies. In such a case, the chamber 16 is preferably of a length sufficient to accommodate casing depth errors, for example 10 ft for a well depth of 10,000 ft.

The tool 32 is then operated to drill through the casing 19, buffer tube 22, chamber 16, cement 26 and into the formation 30. Once the hole is drilled, the drill 34 is withdrawn and, if desired, a drawdown can be create across the drilled hole 36 to produce formation fluid and clean the hole of debris or skin damage With the tool in place, it is also possible to make a direct measurement of the formation pressure for comparison with that from the installed sensor or as a calibration.

The hole in the casing 10 is then plugged with a rivet 38 which is pressure tested to ensure that no fluid can flow into the casing 10 at this point. The tool 32 can then be moved to another location to perform a similar drilling and plugging operation, or removed from the well completely.

The drilling and plugging operation can be repeated over time to avoid problems due to the original hole becoming plugged and to provide further direct measurements of the formation pressure to correct for sensor drift or to recalibrate the measurements.

As an alternative to the buffer tube arrangement described above, the chamber 16 can be filled with a permeable material, for example a permeable cement. This allows the pressure gauge 18 to be in fluid communication with the formation directly and means that it is not so important to arrange that the drill pass through a buffer tube to ensure this.

Figure 5:
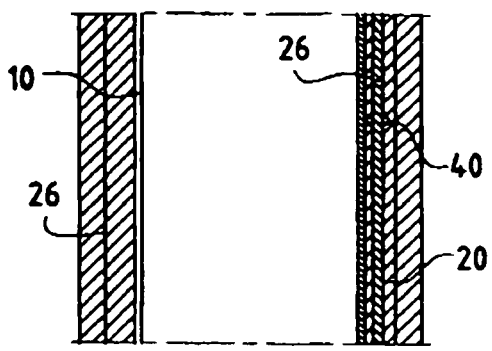
FIG. 5 shows a detail of the casing with cable running along its outer surface.

While FIGS. 1-4 show a single cable 20 running from the pressure gauge 18, it will be appreciated that where multiple gauges are installed in a single well, the cable will need to be connected to each of these. A typical round section cable running along the casing can potentially lead to problems with cement integrity if it lies against the outside of the casing. In particular, the dimensions and shape of the cable can be such that it is not possible to get good cement placement all around the cable, leaving fluid paths running along the casing an compromising the ability of the cement to provide good zonal isolation. The present invention proposes a solution to this problem, as shown in FIG. 5, which comprises providing a number of spacers 40 positioned along the cable 20. These spacers ensure that there is sufficient space between the cable 20 and the casing 10 to allow good cement placement and so avoid the zonal isolation problems identified above. Alternative forms of spacers 40 are shown in FIGS. 6*a* and 6*b*. In FIG. 6*a*, each spacer 40 is formed from a pair of semicircular parts 42, 44 which are mounted on the cable 20 around its outer surface. In FIG. 6*b*, the spacer is formed from four fins 46 spaced equally around the cable 20. These arrangements are preferred but other, similar arrangements might also serve the same objective of spacing the cable from the casing to allow good cement placement.

FIG. 7 shows, schematically, one manner of installing the casing and cable into the well. The casing 10 is added one element at a time, in the conventional manner, from a rig 50. Couplers 54 and centralisers 56 can be located at the joints between casing elements. At the same time, the cable 20 is wound around the casing 10 in a spiral fashion from a spooler 52, by rotating the casing as it is lowered into the well A single cable 20 is shown here, but more than one can be used if required. By winding the cable around the casing in this manner, cement flow around the casing is eased and better cement placement achieved. Also, problems with displacing the cable from the casing are reduced. Such an approach might be used for only part of the completion, a straight run of cabling being used where the casing is to be perforated (to ensure that the position of the cable is known and that the perforation operation does not cut the cable). The pitch of the winding can be varied to suit requirements but may typically be in the range of 1-5 turns per 10 meters. In the embodiment shown in FIGS. 8-11 corresponding features to those of FIGS. 1-4 are given corresponding numbers in the 100 series. In this embodiment, the sensor 118 is positioned in a carrier 114 that is formed from a permeable material such as permeable cement or sintered metal. There is no chamber or buffer tube in this case.

Various changes can be made in the embodiments described above without departing from the inventive concepts disclosed herein.

The invention claimed is:

1. A method of installing a sensor in a well, comprising the steps of:

positioning a casing having a sensor located in a carrier on the outside of the casing, cementing the casing in position, positioning a drilling tool inside the casing adjacent to the carrier, drilling through the casing, carrier and cement into the formation surrounding the well so as to create a fluid communication path and a drawdown across the drilled hole to produce reservoir fluid through the hole for cleaning the hole of debris, sealing the hole drilled in the casing, and removing said tool from the well.

2. The method as claimed in claim 1, further comprising making a direct measurement of formation pressure prior to sealing the hole.

3. The method as claimed in claim 1, wherein the drilling and sealing operations are repeated at intervals throughout the life of the well.

4. The method as claimed in claim 1, wherein the sensor is mounted in a chamber in the earner.

5. The method as claimed in claim 4, wherein the sensor is mounted at one end of an elongate chamber, the hole being drilled through the chamber at a point remote from the location of the sensor.

6. The method as claimed in claim 4, wherein a buffer tube is installed in the chamber which extends to the sensor, the hole being drilled through the buffer tube as well as the chamber.

7. The method as claimed in claim 4 wherein the chamber is be filled with a permeable material, the hole being drilled through the permeable material.

8. The method as claimed in claim 7 wherein the permeable material is selected from the list consisting of permeable cement and sintered metal.

9. The method as claimed in claim 1, wherein the carrier comprises a permeable material encapsulating the sensor.

10. The method as claimed in claim 1, comprising positioning the drilling and plugging tool inside the casing relative to the chamber through which it is to drill using an indexing system located inside the casing.

11. The method as claimed in claim 10, further comprising using a measurement of formation properties to indicate the depth of the tool in the well.

12. The method as claimed in claim 1, wherein a series of sensors are installed, each in a separate chamber on the outside of a respective casing.

13. The method as claimed in claim 1, further comprising running a cable along the outside of the casing in the well from the or each sensor to the surface.

14. The method as claimed in claim 13, wherein when installing the casing carrying sensors into the well, the casing can be rotated as it is inserted into the well such that the cable is wound in a spiral manner around the casing.

15. The method as claimed in claim 13, comprising providing regularly spaced spacers on the cable which allow a space to be maintained between the cable and the outside of the casing.

16. A method of installing a sensor in a well, comprising the steps of:

positioning a casing having a sensor located in a carrier on the outside of the casing.

cementing the casing in position, positioning a drilling tool inside the casing adjacent to the carrier, drilling though the casing, carrier and cement into the formation surrounding the well so as to create a fluid communication path and a drawdown across the drilled hole to producing reservoir fluid through the hole, sealing the hole drilled in the casing, removing said tool from the well, and wherein a series of sensors are installed, each in a separate chamber on the outside of a respective casing.

17. A method of installing a sensor in a well, comprising the steps of:

positioning a casing having a sensor located in a carrier on the outside of the casing, cementing the casing in position, positioning a drilling tool inside the casing adjacent to the carrier, running a cable along the outside of the casing in the well from the sensor to the surface, drilling through the casing, carrier and cement into the formation surrounding the well so as to create a fluid communication path and a drawdown across the drilled hole to producing reservoir fluid through the hole, sealing the hole drilled in the casing, and removing said tool from the well.

18. A method of installing a sensor in a well, comprising the steps of:

positioning a casing having a sensor located in a carrier on the outside of the casing, wherein the sensor is mounted in a chamber in the carrier and a buffer tube is installed in the chamber which extends to the sensor, cementing the casing in position, positioning a drilling tool inside the casing adjacent to the carrier, drilling through the drilling tube, chamber, casing, carrier and cement into the formation surrounding the well so as to create a fluid communication path and a draw-down across the drilled hole to producing reservoir fluid through the hole, and sealing the hole drilled in the casing.

* * * * *